US007601016B2

(12) United States Patent
Ishibashi

(10) Patent No.: US 7,601,016 B2
(45) Date of Patent: Oct. 13, 2009

(54) CONNECTOR SUBSTRATE AND SPEAKER INPUT TERMINAL CONNECTION STRUCTURE

(75) Inventor: Hiroyuki Ishibashi, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 35 days.

(21) Appl. No.: 12/076,909

(22) Filed: Mar. 25, 2008

(65) Prior Publication Data

US 2008/0242146 A1 Oct. 2, 2008

(30) Foreign Application Priority Data

Mar. 26, 2007 (JP) ..... 2007-078194

(51) Int. Cl.
*H01R 13/02* (2006.01)

(52) U.S. Cl. ..... 439/225; 439/516; 439/948

(58) Field of Classification Search ..... 439/225, 439/416, 948

See application file for complete search history.

(56) References Cited

U.S. PATENT DOCUMENTS 4,157,785 A * 6/1979 Freliech ..... 236/1 G
5,335,553 A * 8/1994 Ueki et al. ..... 73/861.19

FOREIGN PATENT DOCUMENTS

JP 59-104636 U 7/1984
JP 3011621 U 5/1995
JP 10-178698 6/1998

* cited by examiner

*Primary Examiner*—Phuong K Dinh
(74) *Attorney, Agent, or Firm*—Morgan Lewis & Bockius LLP

(57) ABSTRACT

In a connector substrate to which are soldered input terminals of a speaker and lead wires connected to an output terminal of a printed circuit board, the connector substrate is flat and approximately rectangular, and snap-off portions for, by being snapped off in a predetermined size, moving extreme positions of a longitudinal direction of the connector substrate, by a predetermined distance, toward an opposite extreme, are formed at either extreme of the longitudinal direction of the connector substrate.

4 Claims, 7 Drawing Sheets

CONNECTOR SUBSTRATE AND SPEAKER INPUT TERMINAL CONNECTION STRUCTURE

This application is based on Japanese Patent Application No. 2007-078194, filed on Mar. 26, 2007, and the content of which are hereby incorporated by reference.

FIELD OF THE INVENTION

The present invention relates to a connector substrate for connecting speaker input terminals, via lead wires, to a printed circuit board including an output terminal, and to a speaker connection structure which uses the connector substrate.

BACKGROUND OF THE INVENTION

To date, for a television set and the like, a number of structures have been proposed in which input terminals of a speaker housed in a cabinet are connected to a printed circuit board which includes an output terminal. As one of them, as shown in FIG. 8, it is proposed that, input terminals 101*a* and 101*b* of a speaker 100 being of a flat rod shape, the input terminals 101*a* and 101*b* are soldered after being inserted into terminal connection slits 104*a* and 104*b*, which are opened in a connector substrate 103 to which one extreme of lead wires 102 is soldered in advance.

In recent years, for a flat screen liquid crystal television and the like, importance being placed on external design and a reduction in product weight, a compact shape has gradually come into use for the cabinet too. As a result thereof, an internal space has become cramped, in particular in left and right side extremes of the cabinet, and there is a case in which a side wall of the cabinet closes in as far as a speaker installation site, and it is only possible to secure an amount of space in which it is barely possible to install the speaker.

Consequently, with a heretofore known shape of the connector substrate 103, there has been a problem in that the side wall of the cabinet has come into contact with a side extreme of the connector substrate 103, resulting in a defect. On attempting to deal with this by cutting off one side extreme of the connector substrate, in order to avoid the side wall of the cabinet, two kinds of connector substrate of differing shapes (bilaterally symmetrical), one for each of left and right speakers, being necessary, a number of parts becomes larger, and a cost increases.

Technologies disclosed in Japanese Unexamined Patent Publication No. 10-178698, Utility Model Registration No. 3011621, and Japanese Patent No. 59-104636, relate to a technology for abolishing a lead wire and a connector which relay a connection of a speaker and a printed circuit board, and are not technologies for connecting a speaker and a lead wire using a connector substrate.

SUMMARY OF THE INVENTION

The invention, being contrived bearing in mind the problem of the heretofore described heretofore known technology, has an object of providing a connector substrate which can be used for both right and left speakers, and which can easily avoid making contact with left and right side walls of a cabinet, and a connection structure of speaker input terminals which uses the connector substrate.

In order to achieve the heretofore described object, a connector substrate of the invention is a connector substrate to which are soldered input terminals of a speaker and lead wires connected to an output terminal of a printed circuit board. In this case, the connector substrate is flat and approximately rectangular, and snap-off portions for, by being snapped off in a predetermined size, moving extreme positions of a longitudinal direction of the connector substrate, by a predetermined distance, toward an opposite extreme, are formed at either extreme of the longitudinal direction of the connector substrate.

According to the connector substrate, by attaching the connector substrate to the speaker input terminals after snapping off one of the snap-off portions of the connector substrate, as the extreme position of the connector substrate moves by the predetermined distance toward the opposite extreme, it is possible to easily prevent a contact between one extreme of the connector substrate and a side wall of the cabinet.

Also, in the connector substrate of the invention, the snap-off portions are formed by providing notches in an orthogonal direction, opposed in positions the predetermined distance from either extreme of opposing long side edges of the connector substrate.

According to the connector substrate, it is possible to easily form snap-off portions which snap off in an approximately rectangular shape.

Also, in the connector substrate of the invention, the input terminals of the speaker are of a flat rod shape, slits for inserting and soldering the input terminals are provided in the connector substrate, opened in positions a predetermined distance from either extreme of the longitudinal direction, and the notches are provided in such a way that the snap-off portions are snapped off across the slits.

According to the connector substrate, it is possible to easily carry out the snapping off of the snap-off portions.

Also, a speaker input terminal connection structure of the invention includes speakers installed at left and right side extremes of an inside of a cabinet, flat rod-shaped input terminals provided on the speakers, a printed circuit board installed inside the cabinet, lead wires of which one extreme is connected to an output terminal of the printed circuit board, and a flat, approximately rectangular connector substrate, to which is soldered the other extreme of the lead wires, having slits for inserting and soldering the input terminals provided opened in positions a predetermined distance from either extreme of a longitudinal direction. In this case, snap-off portions for, by being snapped off, in such a way as to cross the slits, in a predetermined size, moving extreme positions of the longitudinal direction of the connector substrate, by the predetermined distance, toward an opposite extreme, are formed by providing notches in an orthogonal direction, opposed in positions the predetermined distance from either extreme of opposing long side edges of the connector substrate, and in a case in which, in an installation position of the speaker, a distance cannot be secured between one extreme of the longitudinal direction of the connector substrate and a cabinet side wall, the connector substrate coming into contact with the cabinet side wall is prevented by inserting the input terminals into the slits, and soldering them, after snapping off one of the snap-off portions.

According to the speaker input terminal connection structure, by attaching the connector substrate to the speaker input terminals after snapping off one of the snap-off portions of the connector substrate, as the extreme position of the connector substrate moves by the predetermined distance toward the opposite extreme, it is possible to easily prevent a contact between one extreme of the connector substrate and a side wall of the cabinet.

Also, as it is possible, by providing a snap-off portion which snaps off in an approximately rectangular shape at either extreme of the longitudinal direction of the connector substrate, to use identical connector substrates for both left and right speakers, it is possible to reduce a cost in comparison with a case of preparing two kinds of connector substrate with bilaterally symmetrical shapes. Also, when also including cases in which it is not necessary to snap off the snap-off portion, it being possible to comply with a large number of product models, there is an extremely high level of versatility.

Also, as it is possible, by providing a snap-off portion at either extreme of the longitudinal direction of the connector substrate, to use identical connector substrates for both left and right speakers, it is possible to reduce the cost in comparison with the case of preparing two kinds of connector substrate with bilaterally symmetrical shapes. Also, when also including cases in which it is not necessary to snap off the snap-off portion, it being possible to comply with a large number of product models, there is an extremely high level of versatility.

DETAILED DESCRIPTION OF THE PREFERRED EMBODIMENTS

Figure 1A:
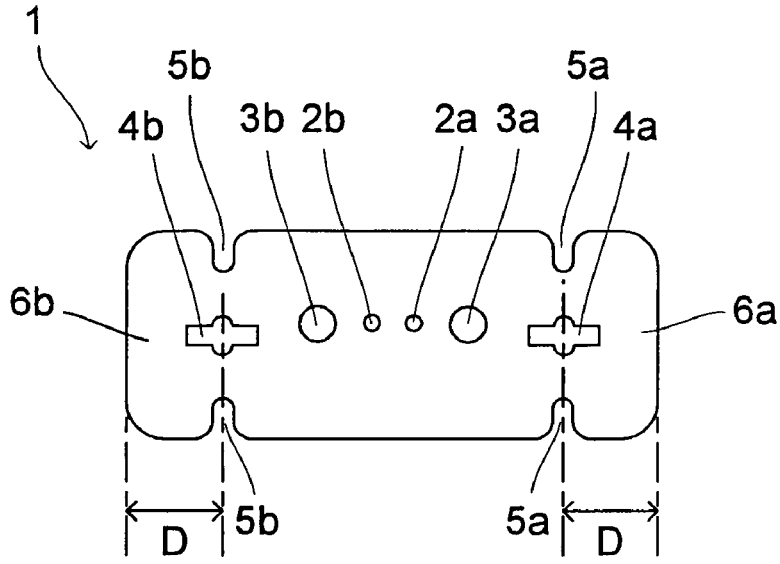
FIG. 1A is a top view of a connector substrate according to an embodiment of the invention.

A description will be given, referring to the drawings, of a preferred embodiment for implementing the invention.

Figure 1B:
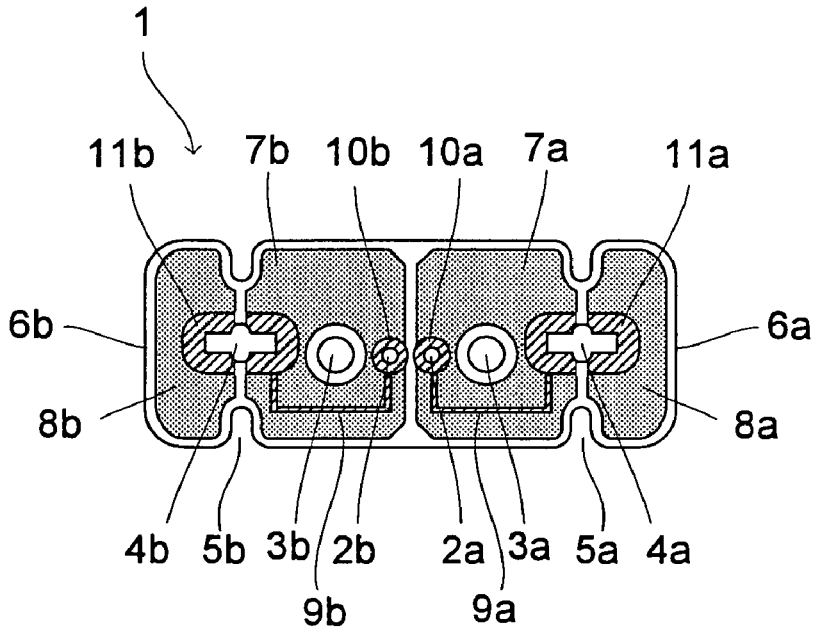
FIG. 1B is a bottom view of the connector substrate according to the embodiment of the invention.
Figure 2:
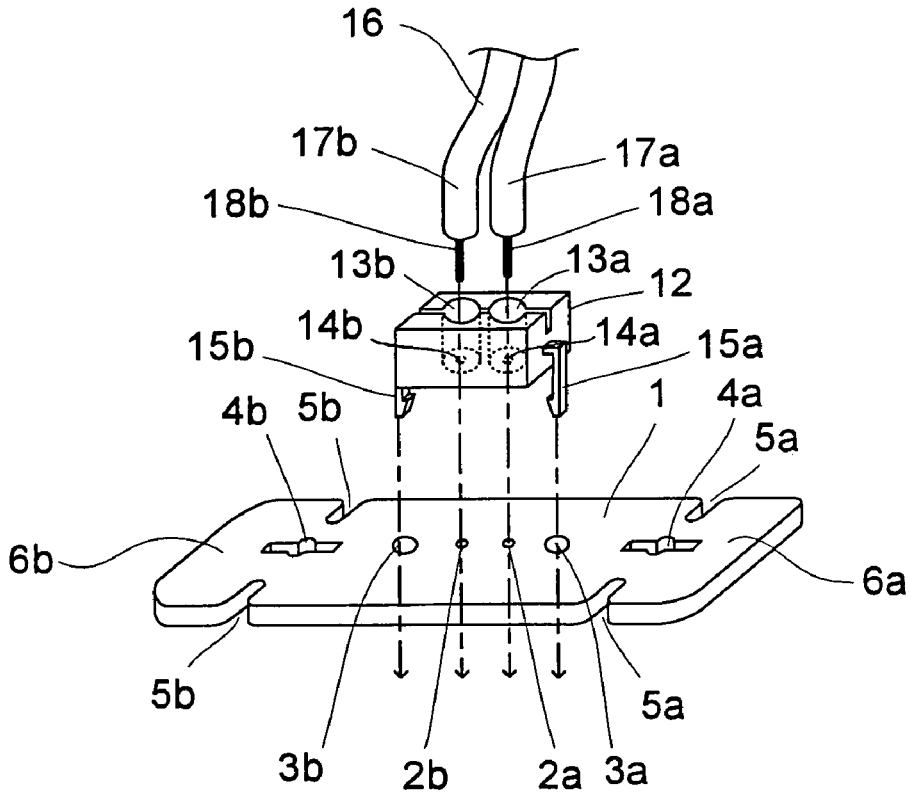
FIG. 2 is an exploded perspective view illustrating a method of fixing lead wires to the connector substrate according to the embodiment of the invention.

FIG. 1A is a top view of a connector substrate according to an embodiment of the invention, FIG. 1B is a bottom view of the connector substrate according to the embodiment of the invention, and FIG. 2 is an exploded perspective view illustrating a method of fixing lead wires to the connector substrate.

The connector substrate 1 shown in FIGS. 1A, 1B and 2 being a plastic substrate member, lead wires 16 (refer to FIG. 2) are soldered in advance, before a speaker input terminal is soldered. As shown in FIG. 1A, the connector substrate 1 being flat and approximately rectangular, a pair of small holes 2*a* and 2*b*, a pair of round holes 3*a* and 3*b*, and a pair of slits 4*a* and 4*b* are provided respectively, in axisymmetrical positions, in an approximately central portion of a longitudinal direction (a left-right direction of the plane of FIG. 1A), adjacent to the small holes 2*a* and 2*b*, and in positions a predetermined distance D from either extreme of the longitudinal direction. A central portion of a longitudinal direction of the slits 4*a* and 4*b* being gouged out in an approximate circle, a distance between the slits 4*a* and 4*b* and opposing long side edges of the connector substrate 1 (an upper side edge and a lower side edge in FIG. 1A) is partially reduced.

Also, a pair of notches 5*a* and 5*b*, extending in an orthogonal direction, are formed opposed in axisymmetrical positions, in positions the predetermined distance D from either extreme of the opposing long side edges of the connector substrate 1 (the upper side edge and the lower side edge in FIG. 1A). Upper and lower notches 5*a* and 5*a*, and 5*b* and 5*b*, are so designed that extensions thereof intersect exactly with the central portion of the longitudinal direction of the slits 4*a* and 4*b*, gouged out in the approximate circle. By this means, snap-off portions 6*a* and 6*b* for, by being snapped off in a predetermined size, moving extreme positions of the longitudinal direction of the connector substrate 1, by the predetermined distance D, toward an opposite extreme, are formed at either extreme of the longitudinal direction of the connector substrate 1.

As shown in FIG. 1B, circuit portions 7*a* and 7*b*, on which conductor patterns 9*a* and 9*b* are formed by etching a photoresist film formed on a copper foil layer, and dummy circuit portions 8*a* and 8*b*, on which the photoresist film is formed flat on the copper foil layer, are formed in axisymmetrical positions on a bottom surface of the connector substrate 1. Lands 10*a* and 10*b*, and 11*a* and 11*b*, for soldering, made of copper foil, are formed surrounding the small holes 2*a* and 2*b*, and surrounding the slits 4*a* and 4*b*, respectively. The lands 10*a* and 11*a*, and the lands 10*b* and 11*b*, are electrically connected by the conductor patterns 9*a* and 9*b* respectively. The dummy circuit portions 8*a* and 8*b*, being formed on the snap-off portions 6*a* and 6*b*, are dummy circuit portions without conductor patterns.

By arranging in such a way that this kind of connector substrate 1 is molded on the same press as a printed circuit board, using substrate material for manufacturing the printed circuit board, it is possible to reduce a manufacturing cost.

Using a holder 12, composed of a kind of prismatic-shaped plastic part shown in FIG. 2, one extreme of the lead wires 16, of which the other extreme is connected to an output terminal of a printed circuit board (not shown), is connected to the connector substrate 1 configured in the way heretofore described. A pair of cylindrical counterbores 13*a* and 13*b* being provided extending in a downward direction from a top surface of the holder 12, through holes 14*a* and 14*b* are opened, from a center of a bottom surface of the counterbores 13*a* and 13*b* respectively, toward a bottom surface of the holder 12. Leg-shaped hooks 15*a* and 15*b* are integrally formed one each on right and left extreme surfaces of the holder 12.

As shown in FIG. 2, an attachment of the lead wires 16 to the holder 12 is carried out by, as well as holding covered portions 17*a* and 17*b* of the lead wires 16 by pressing them into the counterbores 13*a* and 13*b* of the holder 12, passing copper wire portions 18*a* and 18*b*, exposed by cutting away leading extremes of the covered portions 17*a* and 17*b*, through the through holes 14*a* and 14*b* of the holder 12. Then, a fixing of the holder 12 to the connector substrate 1 is carried out by fitting the hooks 15*a* and 15*b* of the holder 12 into the round holes 3*a* and 3*b* of the connector substrate 1. At this time, the copper wire portions 18*a* and 18*b* of the lead wires 16 are inserted through the small holes 2*a* and 2*b* of the connector substrate 1. Finally, on the copper wire portions 18*a* and 18*b* of the lead wires 16 being soldered to the lands 10*a* and 10*b* of the connector substrate 1 (refer to FIG. 1B), a connection of the lead wires 16 and connector substrate 1 is completed.

By using this kind of method of connecting the lead wires 16 and connector substrate 1 using the holder 12 in a connection of the lead wires 16 and the output terminal of the printed circuit board (not shown) too, it becomes possible to use regular, low-priced articles, with no connector, as the lead wires, and a cost reduction is achieved.

Figure 3:
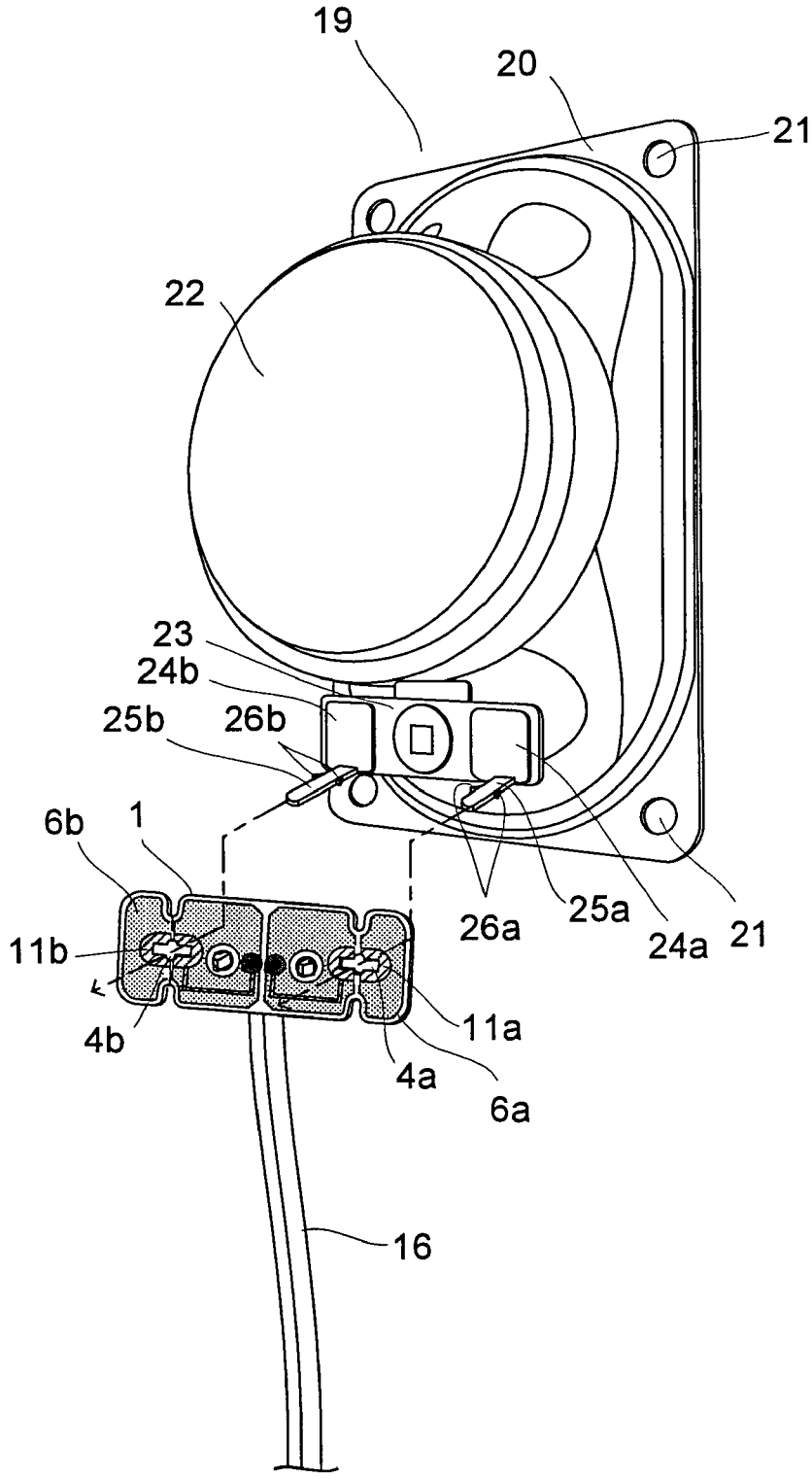
FIG. 3 is an exploded perspective view illustrating a method of attaching the connector substrate to speaker input terminals, without snapping off a snap-off portion of the connector substrate according to the embodiment of the invention.
Figure 4:
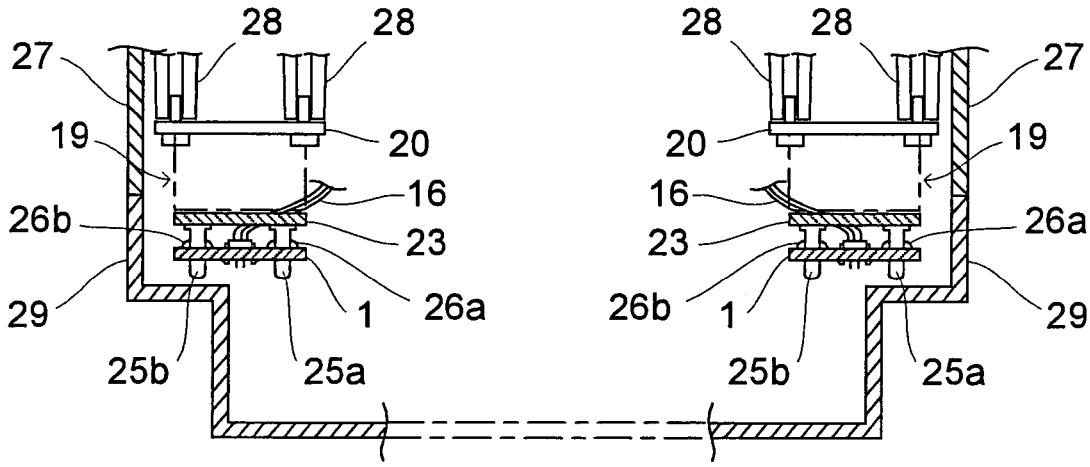
FIG. 4 is an outline horizontal sectional view showing an installation condition of the connector substrate inside a cabinet, in a case in which, in an installation position of a speaker, a sufficient distance can be secured between a left (right) extreme of the connector substrate, attached as in FIG. 3, and a left (right) side wall of a rear cabinet.

Next, a description will be given of a speaker. As shown in FIG. 3, a speaker 19, having a flange 20 on a front surface, is fixed by screwing to bosses 28 (refer to FIG. 4) provided protruding from a front cabinet 27 (refer to FIG. 4) of a television set, using screw holes 21 provided at four corners of the flange 20. As shown in FIG. 4, speakers 19 are disposed one each at left and right extremes of an inside of the front cabinet 27.

As shown in FIG. 3, a substrate member 23 is attached by caulking to a lower portion of a main body 22 of the speaker 19. A pair of terminal members 24*a* and 24*b*, made of sheet metal, are mounted on the substrate member 23. Flat rod-shaped input terminals 25*a* and 25*b* are formed integrated in a lower extreme central portion of the terminal members 24*a* and 24*b* respectively. The input terminals 25*a* and 25*b* are bent approximately 90 degrees backwards at a base. Also, stoppers 26*a* and 26*b* are formed integrated on both sides of the input terminals 25*a* and 25*b* respectively.

Next, a description will be given, referring to FIGS. 3 to 7, of an operation of attaching the connector substrate 1 to the input terminals 25*a* and 25*b* of the speaker 19.

Firstly, a description will be given of a case in which, in an installation position of the speaker 19, a sufficient distance can be secured between a left (right) extreme of the connector substrate 1 and a left (right) side wall of a rear cabinet 29, as shown in FIG. 4. In this case, it is sufficient that the input terminals 25*a* and 25*b* of the speaker 19 are inserted respectively into the slits 4*a* and 4*b* of the connector substrate 1 until the connector substrate 1 is caught by the stoppers 26*a* and 26*b*, and soldered to the lands 11*a* and 11*b*, as shown in FIG. 3. That is, as there is sufficient spatial latitude between the left (right) extreme of the connector substrate 1 and the left (right) side wall of the rear cabinet 29, at a time of attaching the connector substrate 1 to the input terminals 25*a* and 25*b* of the speaker 19, even when not altering the shape of the connector substrate 1 in any way, there does not occur a problem whereby the connector substrate 1 becomes an impediment, and it becomes impossible to attach the rear cabinet 29 to the front cabinet 27.

Figure 5:
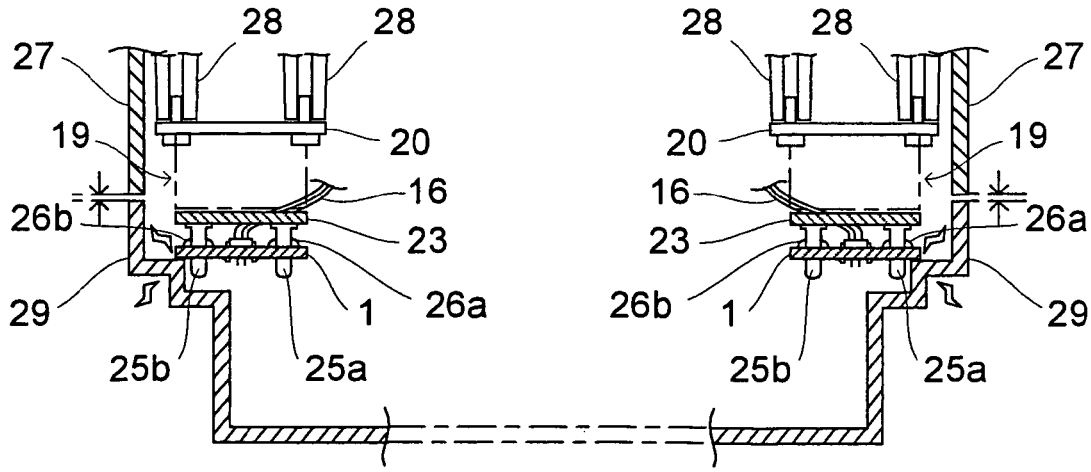
FIG. 5 is an outline horizontal sectional view showing a condition in which the rear cabinet cannot be attached to a front cabinet, in a case in which, in the installation position of the speaker, a sufficient distance cannot be secured between the left (right) extreme of the connector substrate, attached as in FIG. 3, and the left (right) side wall of the rear cabinet.

However, in a case in which, in the installation position of the speaker 19, a distance cannot be secured between the left (right) extreme of the connector substrate 1 and the left (right) side wall of the rear cabinet 29, due to a change in a design of the rear cabinet 29, as shown in FIG. 5, in the event that the attachment of the connector substrate 1 to the input terminals 25*a* and 25*b* of the speaker 19 is carried out without altering the shape of the connector substrate 1 in any way, as heretofore described, the left (right) extreme of the connector substrate 1 comes into contact with the left (right) side wall of the rear cabinet 29, and it is impossible to attach the rear cabinet 29 to the front cabinet 27.

Figure 6:
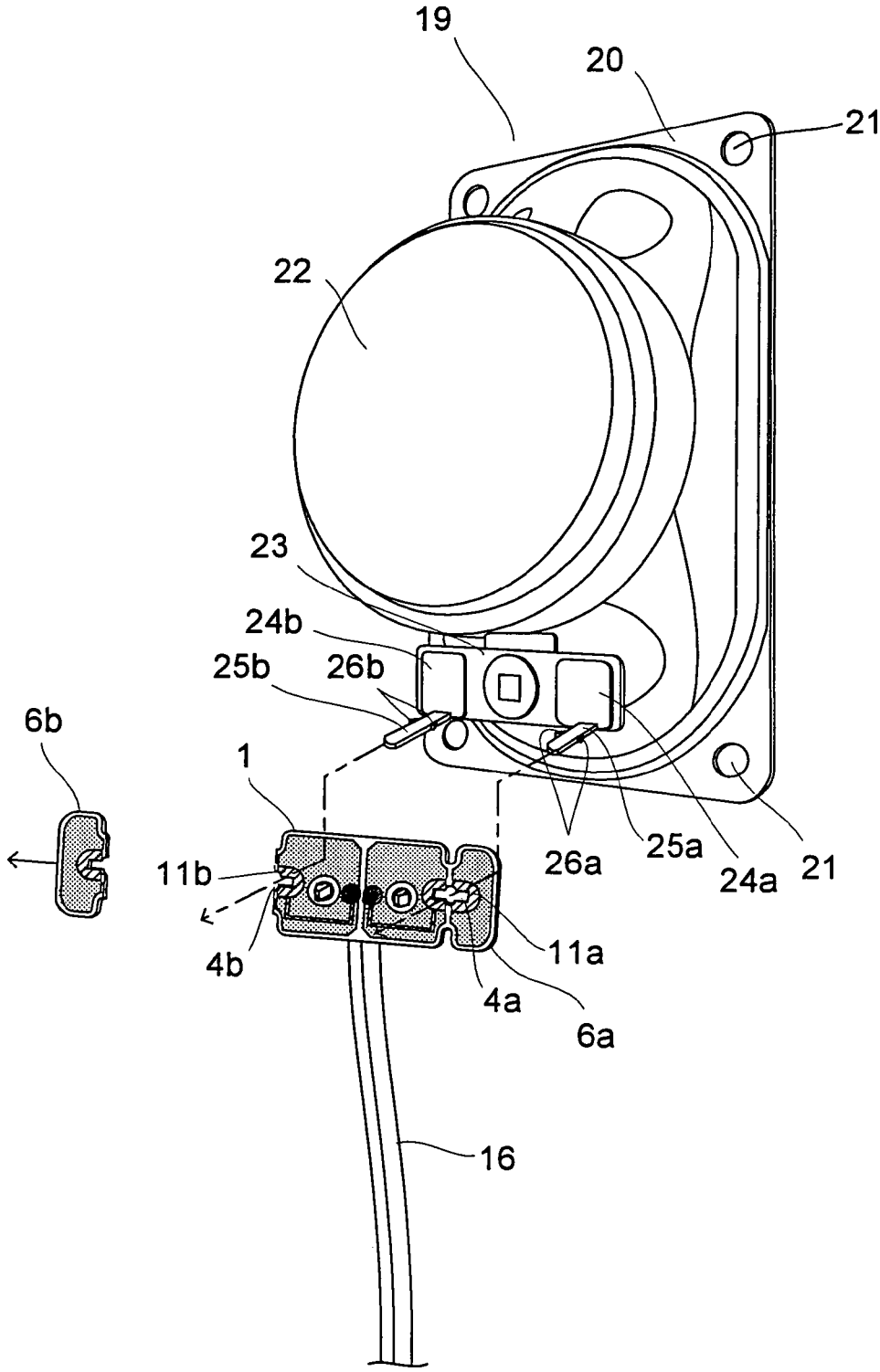
FIG. 6 is an exploded perspective view illustrating one example of a method of attaching the connector substrate to the speaker input terminals, after snapping off a snap-off portion of the connector substrate according to the embodiment of the invention.
Figure 7:
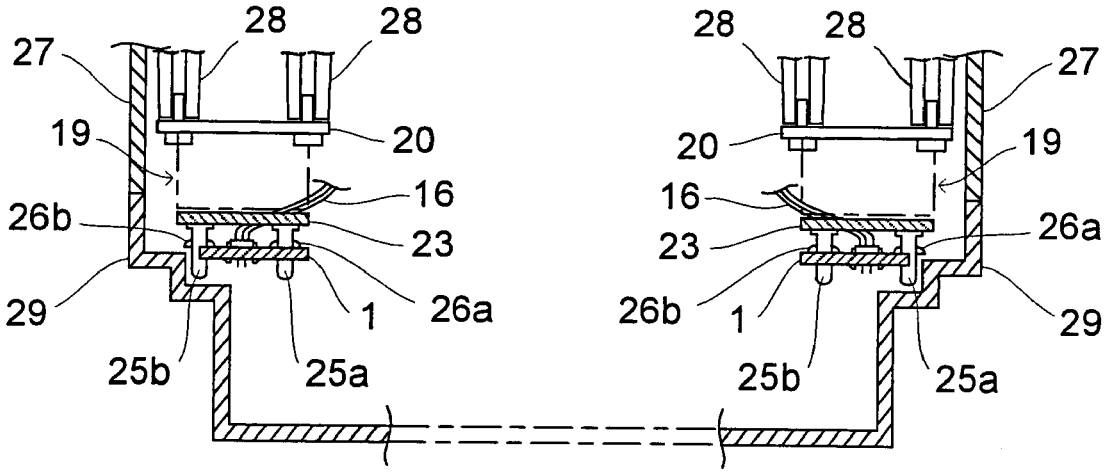
FIG. 7 is an outline horizontal sectional view showing an installation condition of the connector substrate inside the cabinet, in a case in which, in the installation position of the speaker, a sufficient distance cannot be secured between the left (right) extreme of the connector substrate, attached as in FIG. 6, and the left (right) side wall of the rear cabinet.
Figure 8:
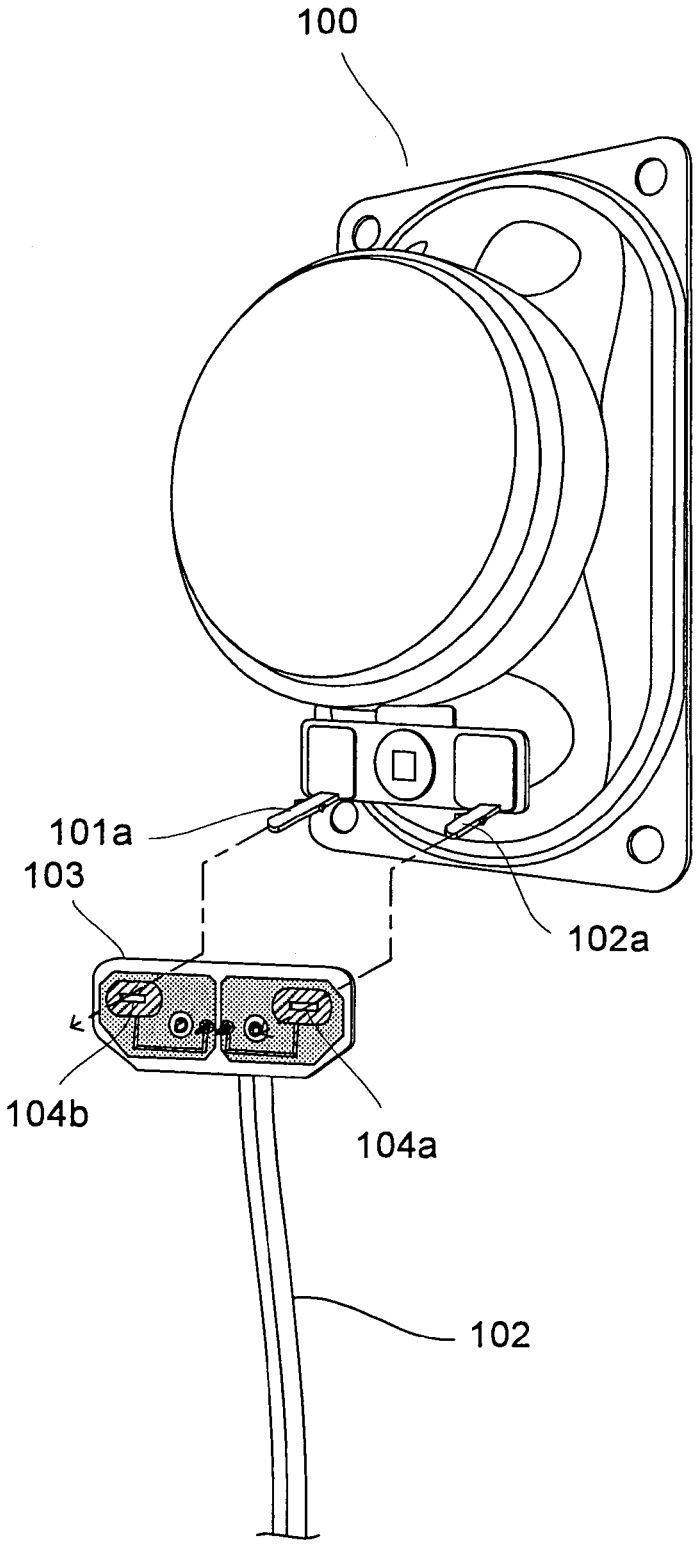
FIG.8 PRIOR ART
FIG. 8 is an exploded perspective view illustrating one example of an attachment method attaching a heretofore known connector substrate to speaker input terminals.

Therein, as shown in FIG. 6, with regard to the speaker 19 on the left, the connector substrate 1 is attached to the input terminals 25*a* and 25*b* of the speaker 19, in the same way as heretofore described, after snapping off the snap-off portion 6*b* on a left side of the connector substrate 1 (with regard to the speaker 19 on the right, after snapping off the snap-off portion 6*a* on a right side of the connector substrate 1). By so doing, as a left (right) extreme position of the connector substrate 1 moves by the predetermined distance D (refer to FIG. 1A) toward the opposite extreme, as shown in FIG. 7, it is possible to prevent the contact between the left (right) extreme of the connector substrate 1 and the left (right) side wall of the rear cabinet 29, and it becomes possible to attach the rear cabinet 29 to the front cabinet 27.

As it is possible to use identical connector substrates 1 for both the left and right speakers, it is possible to reduce a cost in comparison with a case of preparing two kinds of connector substrate with bilaterally symmetrical shapes. Also, when also including cases in which it is not necessary to snap off the snap-off portion, it being possible to comply with a large number of product models, there is an extremely high level of versatility.

The invention is not limited to the heretofore described embodiment. For example, in the heretofore described embodiment, in order to reduce a length of the notches 5*a* and 5*b* for snapping off the snap-off portions 6*a* and 6*b*, it is arranged in such a way that the snap-off portions are snapped off across the slits 4*a* and 4*b*, but there is no objection either to a kind of configuration which provides longer notches in positions in which they do not cross the slits. In this case, by changing a position and direction in which the notches are provided, it is also possible to arrange in such a way as to snap off in an approximately triangular shape, or in an approximately concave pentagonal shape.

What is claimed is:

1. A connector substrate, to which are soldered input terminals of a speaker and lead wires connected to an output terminal of a printed circuit board, wherein the connector substrate is flat and approximately rectangular, and snap-off portions for, by being snapped off in a predetermined size, moving extreme positions of a longitudinal direction of the connector substrate, by a predetermined distance, toward an opposite extreme, are formed at either extreme of the longitudinal direction of the connector substrate.

2. The connector substrate according to claim 1, wherein the snap-off portions are formed by providing notches in an orthogonal direction, opposed in positions the predetermined distance from either extreme of opposing long side edges of the connector substrate.

3. The connector substrate according to claim 2, wherein the input terminals of the speaker are of a flat rod shape, slits for inserting and soldering the input terminals are provided in the connector substrate, opened in positions a predetermined distance from either extreme of the longitudinal direction, and the notches are provided in such a way that the snap-off portions are snapped off across the slits.

4. A speaker input terminal connection structure, comprising:

speakers installed at left and right side extremes of an inside of a cabinet;

flat rod-shaped input terminals provided on the speakers;

a printed circuit board installed inside the cabinet;

lead wires of which one extreme is connected to an output terminal of the printed circuit board; and a flat, approximately rectangular connector substrate, to which is soldered the other extreme of the lead wires, having slits for inserting and soldering the input terminals provided opened in positions a predetermined distance from either extreme of a longitudinal direction, wherein snap-off portions for, by being snapped off, in such a way as to cross the slits, in a predetermined size, moving extreme positions of the longitudinal direction of the connector substrate, by the predetermined distance, toward an opposite extreme, are formed by providing notches in an orthogonal direction, opposed in positions the predetermined distance from either extreme of opposing long side edges of the connector substrate, and in a case in which, in an installation position of the speaker, a distance cannot be secured between one extreme of the longitudinal direction of the connector substrate and a cabinet side wall, the connector substrate coming into contact with the cabinet side wall is prevented by inserting the input terminals into the slits, and soldering them, after snapping off one of the snap-off portions.

* * * * *